US011116292B2

(12) United States Patent
Demeglio

(10) Patent No.: US 11,116,292 B2
(45) Date of Patent: Sep. 14, 2021

(54) JEWELLERY ITEM COMPRISING AN ELASTIC ELEMENT AND A PLURALITY OF ORNAMENTAL ELEMENTS THREADED ONE AFTER THE OTHER ON THE ELASTIC ELEMENT SO AS TO BE SLIDABLE RELATIVE THERETO AND CONNECTED IN TWOS TO ONE ANOTHER

(71) Applicant: ROBERTO DEMEGLIO S.p.A., Turin (IT)

(72) Inventor: Roberto Demeglio, Turin (IT)

(73) Assignee: ROBERTO DEMEGLIO S.P.A

( * ) Notice: Subject to any disclaimer, the term of this patent is extended or adjusted under 35 U.S.C. 154(b) by 121 days.

(21) Appl. No.: 16/481,659

(22) PCT Filed: Dec. 27, 2017

(86) PCT No.: PCT/IB2017/058410
§ 371 (c)(1),
(2) Date: Jul. 29, 2019

(87) PCT Pub. No.: WO2018/122727
PCT Pub. Date: Jul. 5, 2018

(65) Prior Publication Data

US 2020/0000185 A1 Jan. 2, 2020

(30) Foreign Application Priority Data

Dec. 30, 2016 (IT) ..... 102016000132708

(51) Int. Cl.
*A44C 5/08* (2006.01)
*A44C 5/02* (2006.01)

(52) U.S. Cl.
CPC ..... *A44C 5/022* (2013.01)

(58) Field of Classification Search
CPC ..... A44C 5/022; A44C 5/04; A44C 5/0069; A44C 5/0076; A44C 13/00; A44C 11/00
(Continued)

(56) References Cited

U.S. PATENT DOCUMENTS 311,722 A * 2/1885 Cottle ..... A44C 5/08 59/79.2
687,217 A * 11/1901 Fritschle ..... A44C 5/08 59/79.2
(Continued)

FOREIGN PATENT DOCUMENTS

DE 20108587 U1 9/2001
FR 1108213 A 1/1956
(Continued)

OTHER PUBLICATIONS

International Search Report & Written Opinion issued in PCT/IB2017/058410, dated Mar. 26, 2018, Rijswijk, Netherlands.

*Primary Examiner* — Jack W Lavinder
(74) *Attorney, Agent, or Firm* — Valauskas Corder LLC

(57) ABSTRACT

The jewelry item comprises an elastic element, which extends along an extension direction of the item through the entire length of the item, and a plurality of ornamental elements, which are threaded one after the other on the elastic element so as to be slidable relative to the elastic element and are non-releasably connected in twos to one another. Each ornamental element comprises a hollow body having a pair of longitudinally opposite first faces, namely a right-hand face and a left-hand face, respectively, and a pair of radially opposite second faces, namely an inner face and an outer face, respectively. The right-hand face of each ornamental element has a through opening communicating with an inner cavity of the ornamental element.

18 Claims, 5 Drawing Sheets

(58) Field of Classification Search
USPC ..... 63/5.2
See application file for complete search history.

(56) References Cited

U.S. PATENT DOCUMENTS

| | | | | | |
|---|---|---|---|---|---|
| 1,515,499 | A * | 11/1924 | Lederer | A44C 11/002 | 59/79.2 |
| 1,621,205 | A * | 3/1927 | Jones | A44C 5/08 | 59/79.3 |
| 1,660,438 | A * | 2/1928 | Fielding | A44C 5/08 | 59/79.2 |
| 2,302,426 | A * | 11/1942 | Domler | A44C 5/08 | 59/79.2 |
| 2,608,050 | A * | 8/1952 | Bender | A44C 5/08 | 59/79.2 |
| 2,667,739 | A * | 2/1954 | Flaig | A44C 5/08 | 59/79.2 |
| 2,751,132 | A * | 6/1956 | Myerson | A44C 5/0076 | 224/175 |
| 2,753,682 | A * | 7/1956 | Gerstenblith | A44C 5/08 | 59/79.2 |
| 5,471,787 | A * | 12/1995 | Weder | A47G 7/085 | 206/423 |
| 10,271,619 | B1 * | 4/2019 | Peck | A44C 9/02 | |
| 10,306,957 | B2 * | 6/2019 | Scandolaro | A44C 17/02 | |
| 2015/0335108 | A1 * | 11/2015 | Chiarini | A44C 5/0076 | 63/5.2 |

FOREIGN PATENT DOCUMENTS

| | | | |
|---|---|---|---|
| GB | 2505172 | A | 2/2014 |
| IT | 0001417313 | A1 | 10/2014 |

* cited by examiner

JEWELLERY ITEM COMPRISING AN ELASTIC ELEMENT AND A PLURALITY OF ORNAMENTAL ELEMENTS THREADED ONE AFTER THE OTHER ON THE ELASTIC ELEMENT SO AS TO BE SLIDABLE RELATIVE THERETO AND CONNECTED IN TWOS TO ONE ANOTHER

CROSS-REFERENCE TO RELATED APPLICATIONS

This application is a U.S. National Phase filing of PCT International Patent Application No. PCT/IB2017/058410, having an international filing date of Dec. 27, 2017, which claims priority to Italian Patent Application No. 102016000132708, filed Dec. 30, 2016 each of which is hereby incorporated by reference in its entirety.

FIELD OF THE INVENTION

The present invention relates in general to a jewelry item, such as a bracelet, necklace or ring. More specifically, the present invention relates to a jewelry item comprising an elastic element, such as a spring, which extends through the entire length of the item, and a plurality of ornamental elements, which are threaded one after the other on the elastic element so as to be slidable relative thereto and are non-releasably connected to one another.

BACKGROUND OF THE INVENTION

A jewelry item of the type identified above is known for example from Italian Patent No. 1417313. According to this known solution, the jewelry item comprises a spring and a plurality of hollow ornamental elements, in particular ball-shaped elements, which are slidably threaded on the spring and are connected two by two by means of locking elements. The locking elements are formed by small tubes which have an inner cavity in which the spring extends. Each tube is partly inserted into one ornamental element and partly into the adjacent ornamental element. Each ornamental element therefore has a first through hole and a second through hole, through which a first tube and a second tube extend, respectively, for the connection with a first adjacent ornamental element and a second adjacent ornamental element, respectively. Each tube is widened at the two ends thereof so as to have an outer diameter greater than the diameter of the through holes of the ornamental elements. In this way, therefore, each tube is non-releasably connected to two adjacent ornamental elements. In other words, the ornamental elements of each pair of adjacent ornamental elements are connected to each other in a non-releasable manner, but can however move relative to one another between a position of zero distance from each other, in which the two ornamental elements are in contact with each other, and a position of maximum distance from each other, in which each of the two enlarged ends of the tube is in abutment with the respective ornamental element at the edge of the respective through hole.

SUMMARY OF THE INVENTION

It is an object of the present invention to provide an improved jewelry item with respect to the prior art described above.

This and other objects are fully achieved according to the present invention by a jewelry item having the features described and claimed herein.

In short, the invention is based on the concept of providing a jewelry item of the type identified above, wherein each ornamental element comprises a hollow body having a pair of first longitudinally opposite faces, that is a right-hand face and a left-hand face, respectively, and a pair of second radially opposite faces, that is an inner face and an outer face, respectively, wherein the right-hand face of each ornamental element has a through opening communicating with an inner cavity of the ornamental element, wherein each ornamental element further comprises a nose which is made in one piece with the body and projects longitudinally from the left-hand face of the latter, the nose being provided at its free end with at least one detent tooth and being adapted to enter the inner cavity of the body of an adjacent ornamental element passing through the through opening provided in the right-hand face of this latter ornamental element, wherein each ornamental element is also provided with locking means arranged to cooperate with said at least one detent tooth of the nose of an adjacent ornamental element to prevent each pair of adjacent ornamental elements from disengaging from each other, and wherein the nose of each ornamental element also has a through hole through which the elastic element extends.

The features and advantages of the present invention will become more apparent from the following detailed description, given purely by way of non-limiting examples with reference to the accompanying drawings.

Figure 1:
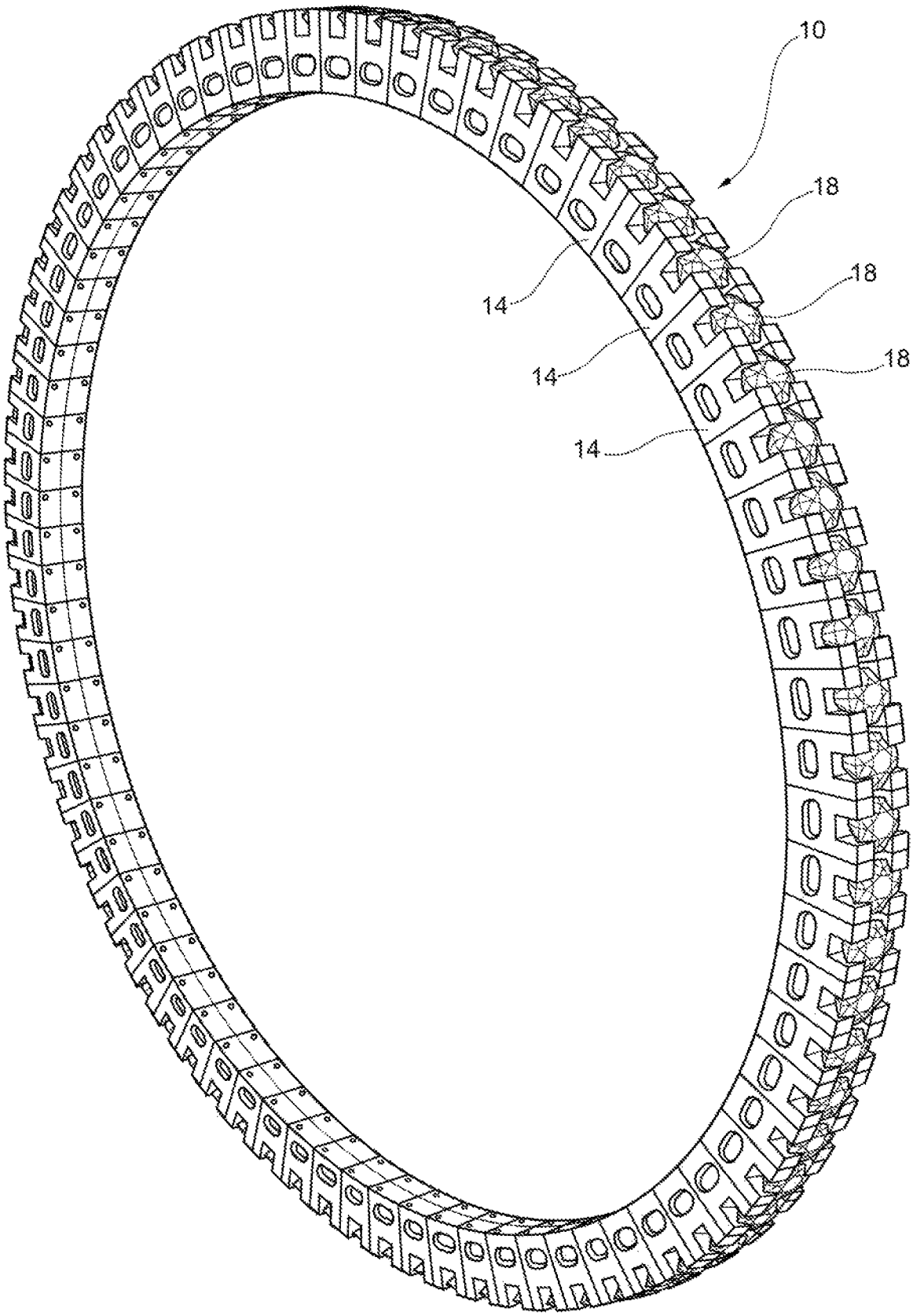
FIG. 1 is a perspective view of a bracelet, as an example of a jewelry item according to the present invention.

With reference first to FIG. 1, a jewelry item according to an embodiment of the present invention is generally indicated with 10. In the embodiment proposed herein, the jewelry item 10 is a bracelet and will therefore be referred to, for the sake of convenience, as bracelet in the following part of the description. Alternatively, the jewelry item may be a necklace or a ring.

The bracelet 10 basically comprises an elastic element 12 (a portion of which can be seen in FIG. 2) which extends along the entire length of the bracelet, and a plurality of ornamental elements 14, which are threaded one after the other on the elastic element 12 so as to be slidable relative thereto and are non-releasably connected to one another.

The elastic element 12 is preferably formed by a mechanical spring (and for this reason it will be indicated hereinafter, for the sake of convenience, as spring), such as a cylindrical helical spring.

The bracelet 10 is shown in FIG. 1 in the condition of normal use, in which the ornamental elements 14 are in contact with one another. In this condition, the bracelet 10 extends, according to the embodiment illustrated herein, along a substantially circular extension direction s. Alternatively, the bracelet 10 may be configured to extend, in the normal use condition, along a non-circular extension direction, for example of an oval or similar shape. The extension direction s lies in a plane, hereinafter referred to as extension plane. In the following description and claims, the term "longitudinal" is used to indicate a direction tangent to the extension direction s, while the term "radial" is used to indicate a direction perpendicular to the extension direction s lying in the extension plane.

Figure 2:
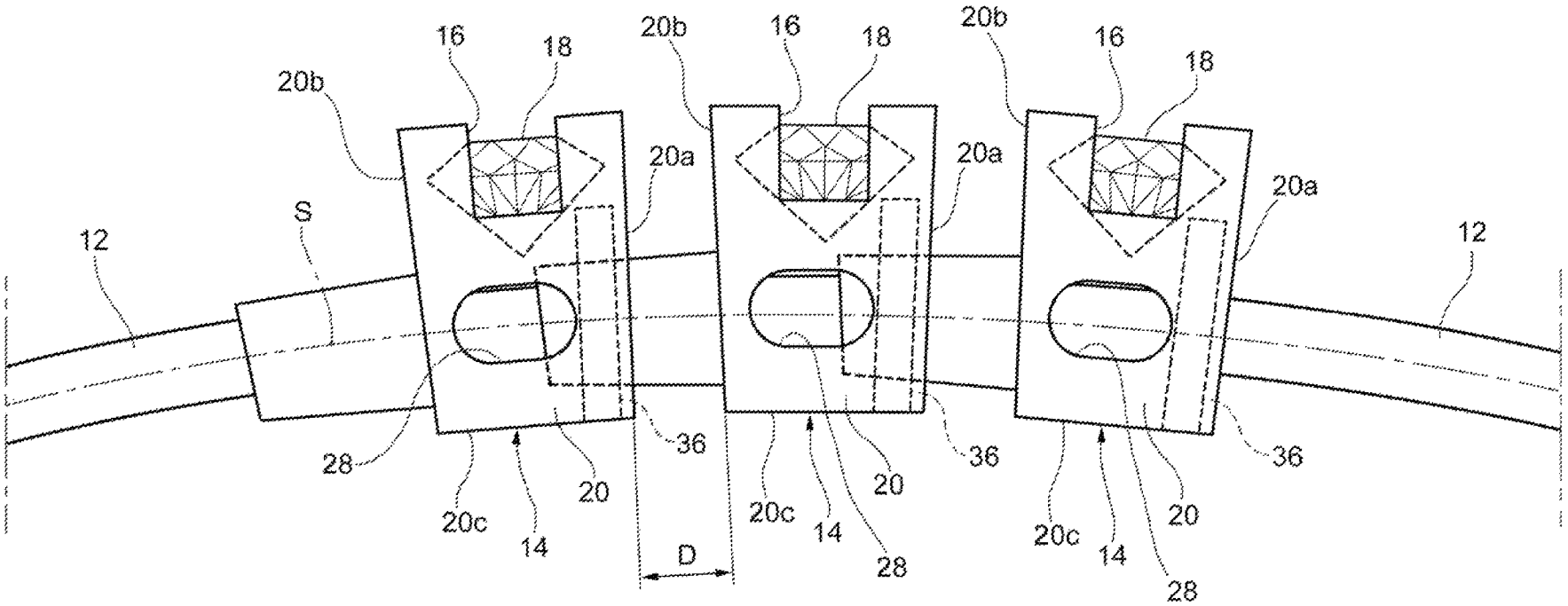
FIG. 2 is a side view which schematically shows a portion of the bracelet of FIG. 1, in the condition of maximum widening of the bracelet.
Figure 3:
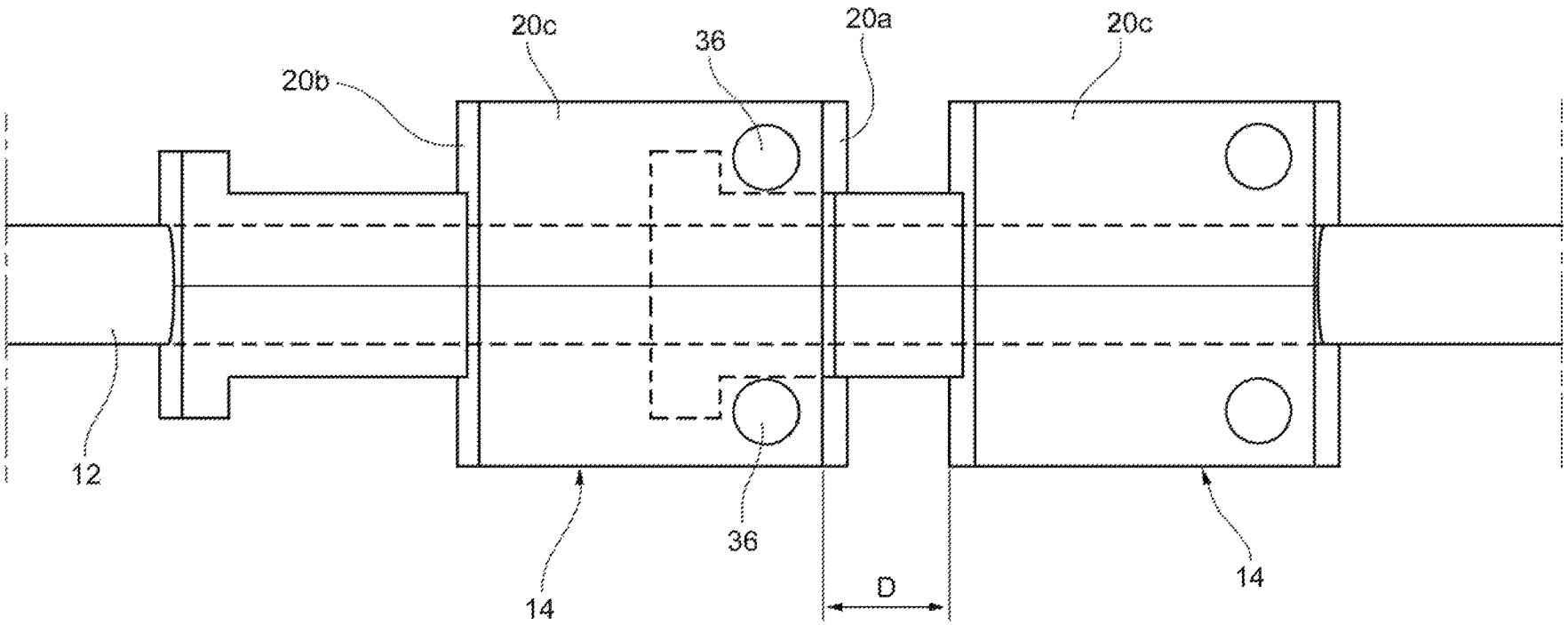
FIG. 3 is a bottom view which shows a pair of adjacent ornamental elements of the bracelet of FIG. 1.
Figure 4:
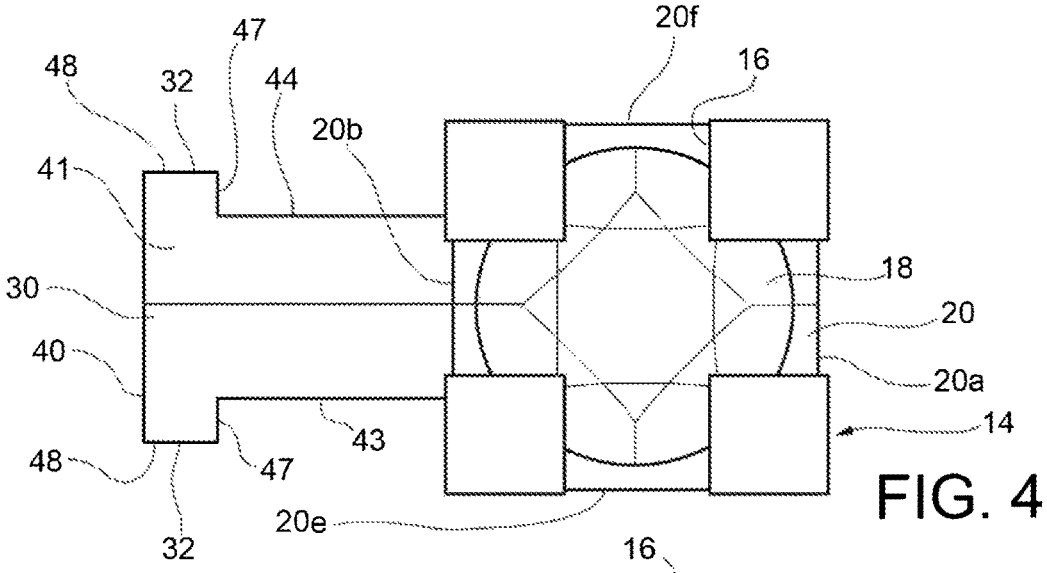
FIGS. 4 to 7 are a top view, a side view, a perspective view and a front view, respectively, of an ornamental element of the bracelet of FIG. 1.
Figure 5:
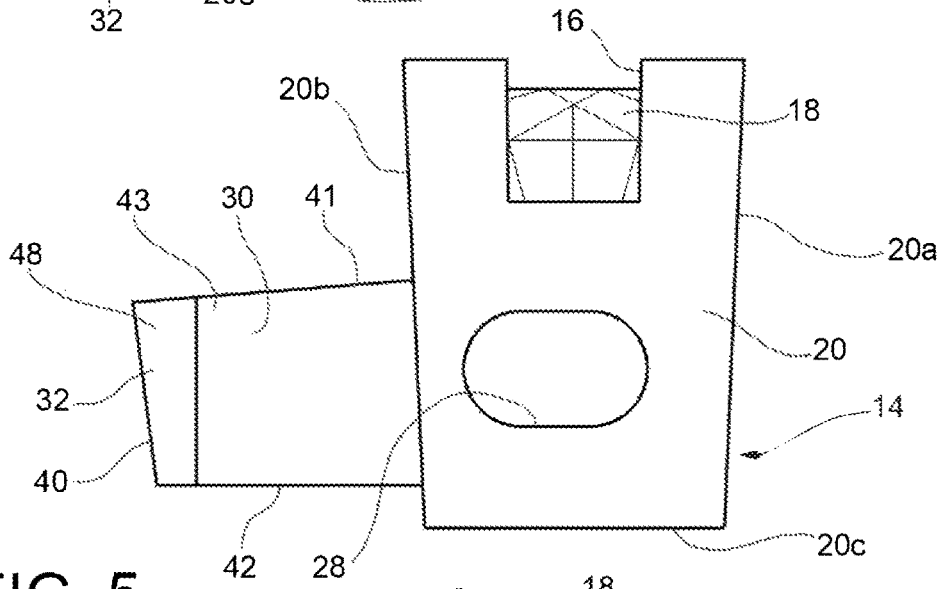
Figure 6:
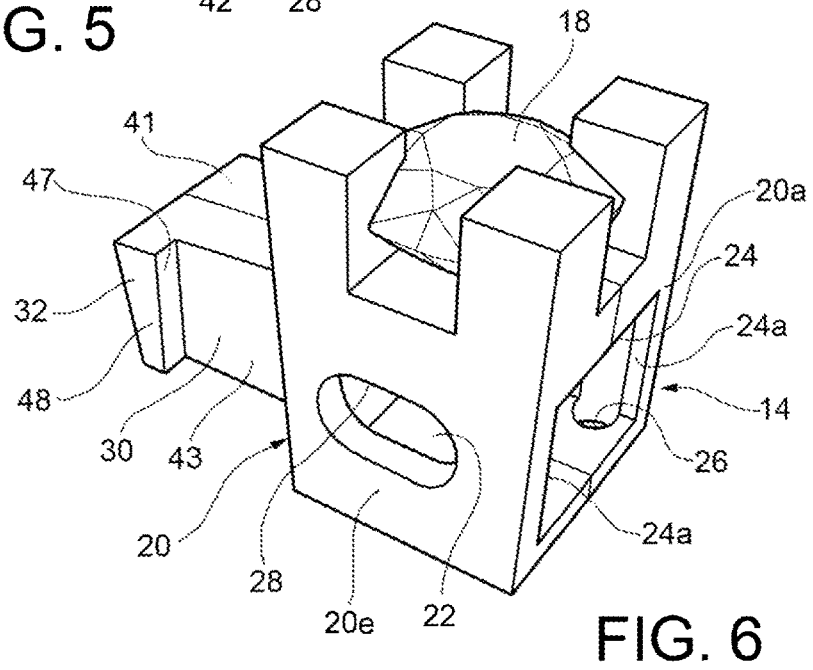
Figure 7:
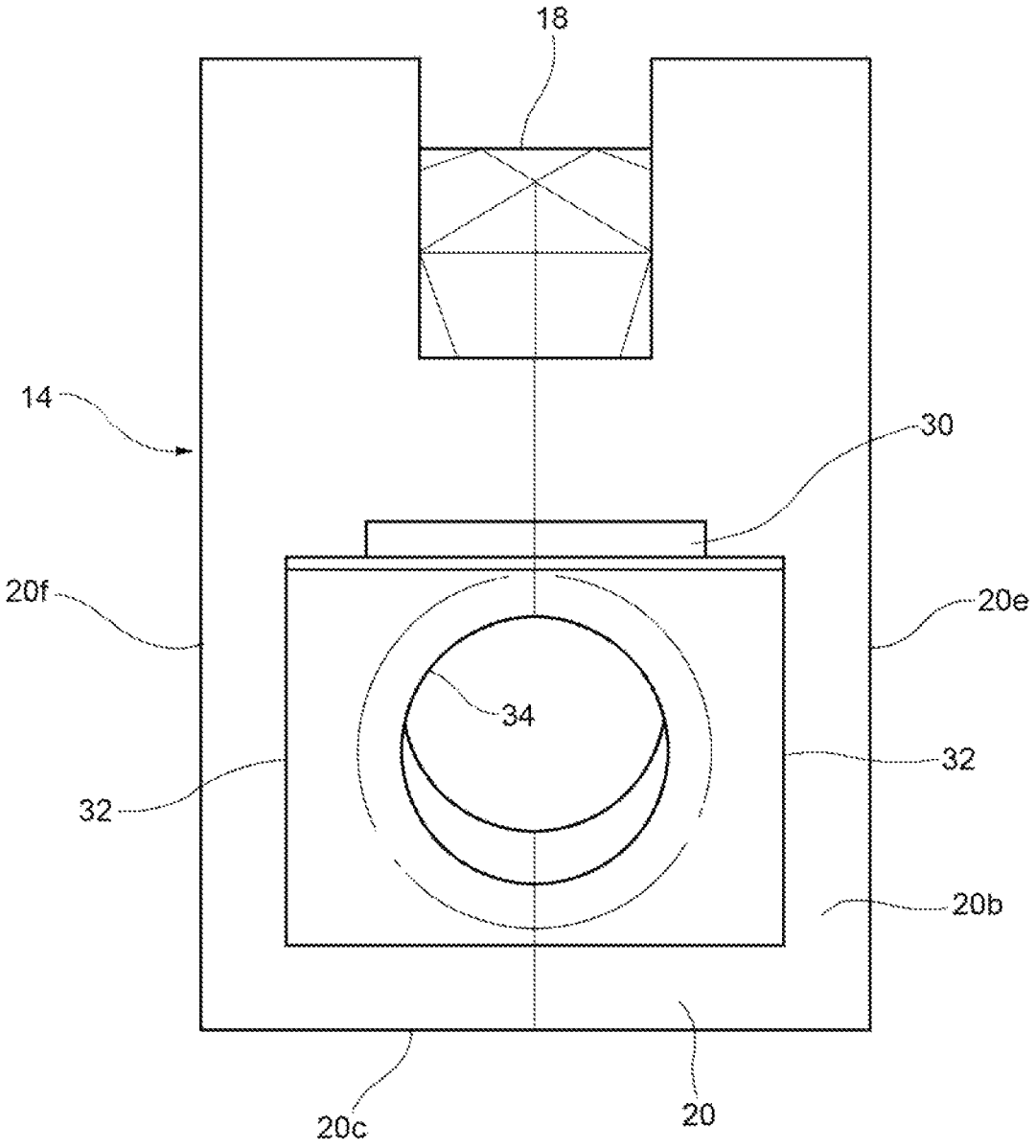

The bracelet 10 is without closure. In order to wear the bracelet 10, the user simply has to widen it, against the elastic action of the spring 12, moving the ornamental elements 14 away from each other up to a maximum distance D from each other (as shown in FIGS. 2 and 3). By releasing the bracelet 10, the ornamental elements 14 return in contact with each other (normal use condition shown in FIG. 1) under the elastic action of the spring 12.

In the embodiment shown in the drawings, the ornamental elements 14 are provided with settings 16 for receiving one or more gemstones or diamonds 18. The presence of settings is not however an essential feature of the invention.

With reference now also to FIGS. 2 to 7, the structure of each ornamental element 14 of the bracelet 10 will now be described in detail.

Each ornamental element 14 comprises a body 20 preferably having an overall parallelepiped shape. The body 20 is a hollow body having an inner cavity 22. The body 20 is made of a metal material, in particular of a precious metal, such as gold. The body 20 may be produced, for example, by machining or micro-casting process. The body 20 has a first pair of longitudinally opposite faces 20*a* and 20*b*, that is a right-hand face and a left-hand face, respectively, a second pair of radially opposite faces 20*c* and 20*d*, that is an inner face and an outer face, respectively, and a third pair of side faces 20*e* and 20*f*.

The two longitudinally opposite faces 20*a* and 20*b* are arranged inclined to each other so as to converge in a radially inner direction, i.e. towards the centre of the circumference along which the extension direction s extends. These faces might however be parallel to each other, to allow to obtain bracelets or necklaces having, in the normal use condition, one or more straight sections, rather than curvilinear ones. The right-hand face 20*a* has a through opening 24, preferably of a rectangular shape, communicating with the inner cavity 22.

The two radially opposite faces 20*c* and 20*d* are preferably arranged parallel to each other, in particular arranged tangentially to the extension direction s. The inner face 20*c* has, on the side of the right-hand face 20*a*, a pair of through holes 26 (one of which is visible in FIG. 6) each arranged near a respective side edge 24*a* of the opening 24. Instead of two through holes 26, a single through hole may be provided near one of the two side edges 24*a* of the opening 24. Alternatively, the two through holes 26 (or the through hole 26, in the case of a single hole) might be provided in one of the two side faces 20*e* and 20*f*, instead of the inner face 20*c*, near the two upper and lower edges (or near one of said edges only, in the case of a single through hole 26) of the opening 24.

In the illustrated embodiment, the outer face 20*d* of the body 20 is provided with a setting 16. In the proposed example, only one setting 16 is provided, which is adapted to receive a single gemstone 18, but a plurality of settings 16 may be provided (for example two settings) in the case of ornamental elements 14 each provided with a plurality of gemstones 18.

The two side faces 20*e* and 20*f* are preferably arranged parallel to one another and parallel to the extension plane. According to the embodiment shown in the drawings, the two side faces 20*e* and 20*f* each have an opening or window 28, for example in the shape of a slot, communicating with the inner cavity 22, but they might also be completely closed.

Each ornamental element 14 further comprises a nose 30 which is integrally formed with the body 20 and projects longitudinally from the left face 20*b* thereof and terminates at an end surface 40. End surface 40 of nose 30 is inclined to converge in the radially inner direction, i.e., towards the centre of the circumference along which the extension direction s extends. The nose 30 is configured to be inserted into the through opening 24 provided in the right-hand face 20*a* of an adjacent ornamental element 14 (as can be seen from FIGS. 2 and 3). The nose 30 is provided, at its free end, with a pair of laterally projecting detent teeth 32, such that the nose 30 has a substantially T shape in plane. More specifically, the nose 30 comprises a top surface 41 opposing a bottom surface 42 connected by two opposing side surfaces 43, 44. Top surface 41 slopes positively from end surface 40 to left face 20*b*. Each tooth 32 protects laterally from an opposing side surface 43, 44, and is defined by the end surface 40, a forward face 47, and an adjacent face 48. In place of a pair of detent teeth, however, only one detent tooth may be provided. The width of the nose 30 at the free end thereof, including the detent teeth 32, is smaller (or better, not larger) than the width of the through opening 24, i.e. the distance between the side edges 24*a* thereof, so to allow, during the assembly of the bracelet 10, inserting the nose 30 of each ornamental element 14 into the inner cavity 22 of the adjacent ornamental element through the through opening 24. The nose 30 has a through hole 34 (FIG. 7) through which the spring 12 extends.

Each ornamental element 14 further comprises locking means adapted to cooperate with the detent teeth 32 of the nose 30 of the adjacent ornamental element to firmly constrain the two adjacent ornamental elements, preventing the mutual disengagement thereof, once the nose 30 of the one element is inserted into the inner cavity 22 of the other element through the through opening 24. According to the embodiment proposed herein, such locking means comprise, for each ornamental element 14, a pair of inserts 36, having for example a cylindrical shape, which are inserted into the inner cavity 22 (once the nose 30 of the adjacent ornamental element 14 has been inserted into the inner cavity 22) through the two through holes 26 provided in the inner face 20*c* and are then firmly fixed to the body 20, for example by welding. The inserts 36 are preferably made of the same metal as the body 20. The inserts 36 have a width (or diameter) such that, once inserted into the holes 26 of the body 20, they project from the side edges 24*a* of the through opening 24 towards the interior of the latter, so as to reduce the width of the through opening 24 to such an extent as to prevent the nose 30 from moving out of the ornamental element 14 adjacent to the inner cavity 22.

Naturally, in case the nose 30 is provided with a single detent tooth 32, only one insert 36 will be provided for cooperating with said detent tooth. Moreover, while in the illustrated example the detent teeth 32 project laterally from the nose 30, it is however possible to provide detent teeth projecting from the top and from the bottom of the nose 30, in which case the through holes 26 will be provided, as previously mentioned, in one of the two side walls 20*e* and 20*f* of the body 20.

In this way, the ornamental elements 14 of each pair of adjacent ornamental elements are movable relative to each other between a condition of zero distance from each other (FIG. 1), corresponding to the condition of normal use of the bracelet 10, where the right-hand face 20*a* of the first ornamental element 14 is in contact with the left-hand face 20*b* of the second ornamental element 14, and a position of maximum distance from each other, corresponding to the maximum widening condition of the bracelet 10, where the detent teeth 32 of the nose 30 of the second ornamental element 14 are in abutment against the inserts 36 of the first ornamental element 14.

The bracelet 10 may easily be made as follows.

The ornamental elements 14, with the gemstone(s) 18 (if any) already set, are threaded one after the other on the spring 12 and are firmly connected to one another. The connection between two adjacent ornamental elements 14 is obtained by inserting the nose 30 of the first ornamental element 14 into the inner cavity 22 of the second element through the opening 24 and then inserting the two inserts 36 into the through holes 26 on the inner face 20*c* of the second ornamental element 14 so as to prevent the nose 30 of the first ornamental element 14 from moving out of the inner cavity 22 of the second ornamental element 14. Once inserted into the through holes 26 of the second ornamental element 14, the two inserts are firmly connected to the latter, for example by welding. Before firmly connecting the last two ornamental elements 14 to one another, the two ends of the spring 12 are firmly connected to one another. Once the spring 12 is closed, the last two ornamental elements 14 are connected to one another.

As is clear from the above description, a bracelet or necklace according to the present invention can be assembled very simply and may have even very small ornamental elements, with a size in the order for example of 1-2 mm.

The principle of the invention remaining unchanged, embodiments and constructional details may be greatly modified with respect to those described purely by way of non-limiting examples, without thereby departing from the scope of the invention as described and claimed herein.

The invention claimed is:

1. A jewelry item, in particular a bracelet, a necklace or a ring, comprising an elastic element, which extends along an extension direction of the jewelry item through the entire length of the item, and a plurality of ornamental elements, which are threaded one after the other on the elastic element so as to be slidable relative to the elastic element and are non-releasably connected in twos to one another, wherein each ornamental element comprises a hollow body having a pair of longitudinally opposite first faces, namely a right-hand face and a left-hand face, respectively, and a pair of radially opposite second faces, namely an inner face and an outer face, respectively, wherein the right-hand face of each ornamental element has a through opening communicating with an inner cavity of the ornamental element, wherein each ornamental element has one or more through holes communicating with the inner cavity of the ornamental element, wherein each ornamental element further comprises a nose which is made in one piece with the body and projects longitudinally from the left-hand face of the body, the nose being provided, at its free end, with a pair of detent teeth, each tooth projecting laterally from opposing side surfaces of the nose and being adapted to enter the inner cavity of the body of an adjacent ornamental element passing through the through opening provided in the right-hand face of the adjacent ornamental element, wherein each ornamental element is also provided with locking elements to prevent each pair of adjacent ornamental elements from disengaging from each other, the locking elements comprising an insert positioned in each of the one or more through holes to prevent the nose from moving out of the adjacent ornamental element, and wherein the nose of each ornamental element has also a through hole through which the elastic element extends.

2. The jewelry item of claim 1, wherein said locking elements comprise, for each detent tooth, a respective insert inserted into the body near an edge of the through opening so as to reduce the size of said opening.

3. The jewelry item of claim 2, wherein the inner face of the body has at least one through hole communicating with the inner cavity of the body for insertion of said insert.

4. The jewelry item of claim 2, wherein a lateral face of the body has at least one through hole communicating with the inner cavity of the body for insertion of said insert.

5. The jewelry item of claim 1, wherein the outer face of the body is provided with of at least one setting for receiving a respective gemstone.

6. The jewelry item of claim 1, wherein said first faces are inclined to each other so as to converge radially inwards.

7. The jewelry item of claim 1, wherein the through opening is a rectangular shape.

8. The jewelry item of claim 1, wherein the nose is integrally formed with the body.

9. The jewelry item of claim 1, wherein the nose is defined by a top surface opposing a bottom surface connected by two opposing side surfaces and an end surface.

10. The jewelry item of claim 9, wherein the top surface slopes positively from the end surface to the right hand face.

11. The jewelry item of claim 9, wherein each tooth is defined by the end surface and a forward face each connected by an adjacent face.

12. The jewelry item of claim 9, wherein the end surface of the nose is inclined to converge radially inwards.

13. The jewelry item of claim 9, wherein the insert is positioned parallel to the forward face of each tooth.

14. The jewelry item of claim 1, wherein the body further comprises a pair of opposing side faces.

15. The jewelry item of claim 14, wherein one or more side faces include an opening that communicates with the inner cavity.

16. The jewelry item of claim 14, wherein the opening is in the shape of a slot.

17. The jewelry item of claim 1, wherein the inserts are a cylindrical shape.

18. The jewelry item of claim 1, wherein the insert is welded to the body.

* * * * *